US006168482B1

(12) United States Patent
Okabe

(10) Patent No.: US 6,168,482 B1
(45) Date of Patent: Jan. 2, 2001

(54) ENGINE LIFT FOR OUTBOARD MOTOR

(75) Inventor: Yoshihiko Okabe, Hamamatsu (JP)

(73) Assignee: Sanshin Kogyo Kabushiki Kaisha (JP)

( * ) Notice: Under 35 U.S.C. 154(b), the term of this patent shall be extended for 0 days.

(21) Appl. No.: 09/313,014

(22) Filed: May 17, 1999

(30) Foreign Application Priority Data

May 15, 1998 (JP) ..... 10-132790

(51) Int. Cl.[7] ..... B63H 5/20

(52) U.S. Cl. ..... 440/53; 123/195 P

(58) Field of Search ..... 440/53, 77, 900; 123/195 P, 195 C

(56) References Cited

U.S. PATENT DOCUMENTS 5,616,058 4/1997 Nakai ..... 440/53

FOREIGN PATENT DOCUMENTS

47796 * 3/1985 (JP) ..... 440/53

* cited by examiner

*Primary Examiner*—Jesus D. Sotelo
(74) *Attorney, Agent, or Firm*—Knobbe, Martens, Olson & Bear, LLP

(57) ABSTRACT

An outboard motor generally comprises a power head. An engine is mountable within an engine compartment defined within the power head. The engine is lifting into and out of the engine compartment in part through the use of lifting lugs. The engine may have one or more lifting lugs positioned in various locations for use in suspending the engine from ropes or chains during installation. The lifting lugs may attach to an upper surface of the engine, a portion of the flywheel or a drive unit of a high pressure fuel pump. The lifting lugs may also be positioned in dead space such as that between cylinder banks of a v-type engine. Moreover, the lifting lugs may be removable or pivotable to reduce the protrusion of the lifting jugs from the engine when the outboard motor is in use.

17 Claims, 11 Drawing Sheets

ENGINE LIFT FOR OUTBOARD MOTOR

BACKGROUND OF THE INVENTION

1. Field of the Invention

The present invention generally relates to lift arrangements for engines of outboard motors. More particularly, the present invention relates to lift arrangements for engines for use during installation and maintenance of outboard motor engines.

2. Description of Related Art

Watercraft powered by outboard motors use internal combustion engines mounted within the outboard motor for providing power output to a propulsion device such as a propeller. In assembling the outboard motor, the engine must be positioned within an engine compartment located within a cowling portion of the outboard motor. To lift the engine and to orient the engine properly, the engine may be provided with at least one lifting hook. Typically, the lifting hook is attached to the engine proximate the cylinder block, the crankcase and the cylinder head. In such embodiments, a rope, chain or the like is attached to the lifting hook such that the engine may be raised from, or positioned within, the cowling area of the outboard motor. Lifting the engine may be necessary for routine maintenance, assembly and the like.

As the size and complexity of outboard motors has increased, the difficulties associated with mounting such engines into the outboard motors has also increased. For example, with the recent introduction of two-cycle V-type six-cylinder direct-injection engines into outboard motors, the number of components attached to the engine block has exploded. The engines feature a high-pressure fuel system that is attached to the engine and that protrudes significantly from the contours of previous engine structures. Due to both this increase in parts and the complexity of the assembly procedures associated with the engines, the space allocated to the lifting hook in such engines has decreased. Moreover, the ropes and/or chains used to raise and lower the engine may impact the engine and peripheral components and damage sensitive connections and couplings as a result of the inadvertent contact. Furthermore, as the weight and size of the engines has increased, the size of the hanger has also had to increase. Accordingly, the hanger now protrudes to a large degree from the side of the engine in some embodiments. This large protrusion requires an enlarged cowling region and an overall increase in outboard motor size and weight.

SUMMARY OF THE INVENTION

Accordingly, it is desired to have an outboard motor engine lift apparatus that may reduce the protrusion of the apparatus from the engine, as well as one that may be accommodated by engines having varying peripheral components. Moreover, the apparatus should be located in a region of the engine which allows ease of assembly and manufacture of the engine while also facilitating ease of insertion and orientation of the engine within the outboard motor.

One aspect of the present invention involves an engine for an outboard motor. The engine comprises a generally vertically oriented crankshaft and a flywheel connected to the crankshaft. A peripheral component is attached to a portion of the engine. A driven sprocket is connected to the peripheral component and arranged to power the peripheral component. A drive sprocket is attached to the flywheel with a flexible drive loop extending between and rotatably coupling the drive sprocket to the driven sprocket. A lifting lug is removably connected to one of the flywheel or the drive sprocket.

Another aspect of the present invention involves an engine for an outboard motor. The engine comprises a crankshaft, a flywheel attached to the crankshaft, and a peripheral component attached to a portion of the engine. A driven sprocket is connected to the peripheral component and is arranged to power the peripheral component. A drive sprocket is attached to the flywheel with a flexible drive member coupling the drive sprocket to the driven sprocket. A lifting lug is positioned generally between the drive sprocket and the driven sprocket.

A further aspect of the present invention involves an outboard motor. The outboard motor comprises a power head, an engine compartment defined within the power head and an engine mounted within the engine compartment. The engine comprises a crankshaft, a crankcase encasing the crankshaft and a flywheel attached to the crankshaft. The crankcase is attached to a cylinder block with a pair of cylinder banks positioned within the cylinder block. A removable lifting lug and a pivotable lifting lug are also attached to the engine. One of the removable lifting lug and the pivotable lifting lug is positioned generally above the crankshaft and the other of the removable lifting lug and the pivotable lifting lug is positioned generally rearward of the crankshaft.

BRIEF DESCRIPTION OF THE DRAWINGS

These and other features, aspects and advantages of the present invention will now be described with reference to the drawings of several preferred embodiments, which embodiments are intended to illustrate and not to limit the invention, and in which drawings.

DETAILED DESCRIPTION OF THE PREFERRED EMBODIMENTS OF THE INVENTION

Figure 1:
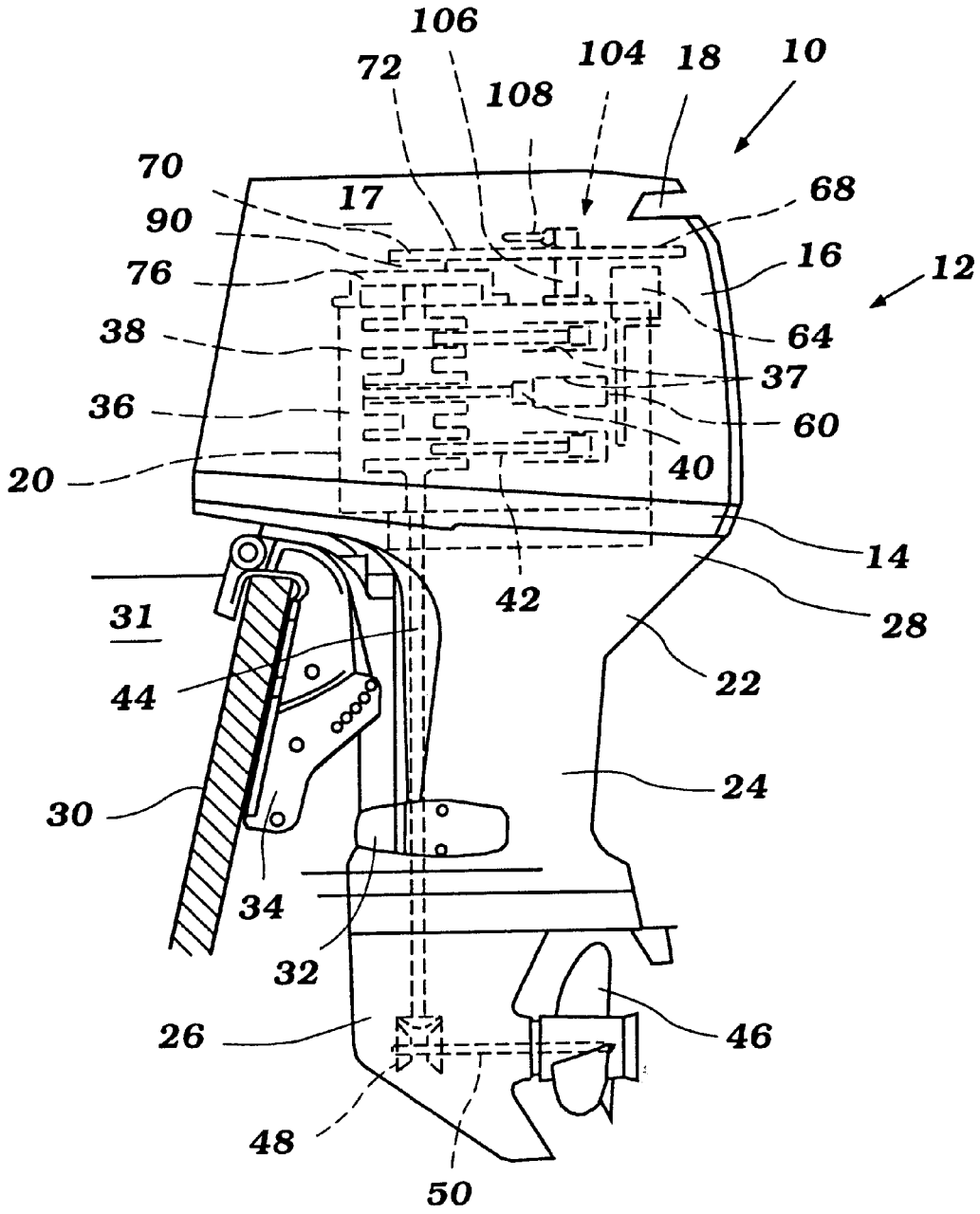
FIG. 1 is a side view of an outboard motor attached to a transom of a watercraft, which is shown in partial section, having certain internal components illustrated with hidden lines.

With initial reference to FIG. 1, an outboard motor for powering watercraft is illustrated therein. The outboard motor, indicated generally by the reference numeral 10, advantageously features a lift arrangement having certain features, aspects and advantages of the present invention. The outboard motor 10 provides an exemplary environment in which the present lift arrangement has particular utility. Other environments of use may readily present themselves to individuals having ordinary skill in the relevant arts. The lift assembly includes one or more lifting lug. The term lifting lug as used herein shall refer to any of a number of mechanical arrangements providing a specific component or structure sized and configured specifically for being gripped for lifting. Accordingly, lifting lugs should be construed to include, but not be limited to, curved clutches, dogs, hooks, claws, clasps, curved members, stays, eyelets, eyebolts, rings, t-bolts, and the like.

With continued reference to FIG. 1, the illustrated outboard motor 10 generally comprises a power head 12 having a lower tray portion 14 and an upper cowling portion 16. The power head components may be manufactured of any suitable material, including, without limitation, reinforced plastics, fiberglass and metals, in any known manner. The lower tray portion 14 and the upper cowling portion 16 preferably are joined together to form a power head area 12 that is substantially weatherproof and water spray resistant. For instance, a rubber seal (not shown) may be positioned in the joining region. Additionally, the lower tray portion 14 and the upper cowling portion generally form an engine compartment 17 in which an engine is positioned and somewhat protected.

An air vent or air inlet area 18, which may be rearward facing, is provided in the illustrated upper cowling portion 16. Air may enter through the vent 18 for induction into an internal combustion engine 20 that is preferably arranged and encased within the power head 12. The air vent 18 may also allow heated air to be exhausted from within the power head 12 after circulation within the power head 12.

With continued reference to FIG. 1, the illustrated outboard motor 10 also includes a lower unit 22 extending downwardly from the lower tray portion 14 of the power head area 12. The illustrated lower unit 22 generally comprises an enlarged upper casing 24 and a narrower lower casing 26. Generally, the illustrated upper casing 24 is connected to the lower tray portion 14 through an apron 28, which encases the lower unit 22 and supports the lower tray portion 14.

The illustrated outboard motor is generally attached to a transom 30 of a watercraft 31 using a mount 32 and a bracket 34 as is well known in the art. The bracket 34 preferably enables both steering and tilt and trim such that the outboard motor 10 may be steered about a substantially vertical axis and tilted or trimmed about a substantially horizontal axis in manners well known to those skilled in the art.

With continued reference to FIG. 1, the engine 20 may be of any configuration. In the illustrated embodiment, the engine 20 is substantially vertically oriented such that an axis of a crankshaft 38 has an inclined or substantially vertical axis. As is known, the illustrated engine 20 generally comprises a cylinder block 36 having a plurality of cylinder bores 37. In some embodiments, the engine 20 may contain as few as one cylinder or more than two cylinders. In the illustrated embodiment, the engine 20 comprises two banks of three cylinders arranged in a V-type engine. As such, two planes are defined along the cylinder banks that are inclined to intersect such that a generally v-shape configuration results.

The engine 20 may also operate on any known operating principle. The illustrated engine 20 preferably operates on a four-cycle principle. It should be understood, however, that the engine may also operate on a two-stroke or rotary principle as well.

A crankshaft is rotatably driven by the engine 20 in any manner well known to those of ordinary skill in the art. Specifically, with reference to FIG. 2, the illustrated engine 20 contains a plurality of pistons 40, which are mounted for reciprocation within the cylinder block 36. The pistons, in turn, are connected to the crankshaft 38 via connecting rods 42 in any suitable manner. Thus, as the pistons are driven by the expansion of gases following combustion, the translating motion is transferred to the crankshaft through the connecting rods. As a result of the movement of the connecting rods, the crankshaft is driven for rotation about its axis.

The illustrated crankshaft 38 is preferably coupled to a downwardly extending driveshaft 44 in any suitable manner. Accordingly, the driveshaft 44 is powered for rotation by the engine 20 through the crankshaft 38. The rotation of the driveshaft 44, in turn, drives a propeller 46 in the illustrated embodiment. The illustrated propeller 46 is driven in both a forward direction and a reverse direction through the shiftable transmission 48. In the illustrated embodiment, this shiftable transmission generally comprises a selectable bevel gear arrangement. The selectable bevel gear arrangement preferably couples the drive shaft 44 to a propeller shaft 50 and the propeller 46. These components are journaled for rotation in any suitable manner, such arrangements being well known to those of ordinary skill in the art.

With reference again to FIG. 1, the illustrated engine 20 is preferably a directly injected engine having at least one fuel injector 60 positioned and arranged to directly inject a charge of fuel into a combustion chamber 62. It is anticipated, however, that the present invention may also be utilized with indirectly injected engines as well. Moreover, in some embodiments, the engine may be of the carbureted type and an air fuel charge may be provided to a combustion chamber through an induction system including a carburetor. The fuel injectors 60 may be positioned to inject fuel into the combustion chambers 62 in any suitable manner.

With reference to FIG. 1, the illustrated engine has a belt-driven high pressure fuel pump 64 mounted to the top and rear of the illustrated engine 20. The fuel pump supplies fuel to the fuel injectors in the illustrated embodiment.

The fuel pump 64 comprises an input shaft 66 mounted on an uppermost surface of the fuel pump 64 in the illustrated embodiment. The illustrated input shaft 66 desirably carries a driven sprocket 68. As used herein, sprocket may refer to a gear, sprocket, pulley, sheave or the like. The driven sprocket 68 may be of any size or configuration known to those of skill in the art. Preferably, the driven sprocket 68 is splined or keyed to the input shaft 66 such that rotation of the driven sprocket 68 is transferred to the input shaft 66.

The driven sprocket 68 is driven by a drive sprocket 70 through the use of a drive belt 72. The drive belt 72 may be a chain, a belt, or any other flexible member coupling the two sprockets 68, 70 together for rotation. Additionally, the two sprockets 68, 70 may be sized to effect either an increase or decrease in revolution speed between the input shaft 66 and the crankshaft 38. The coupling of the sprockets forms, in part, a drive unit for powering the high pressure fuel pump. The drive unit is indicated generally by the reference numeral 74.

Figure 2:
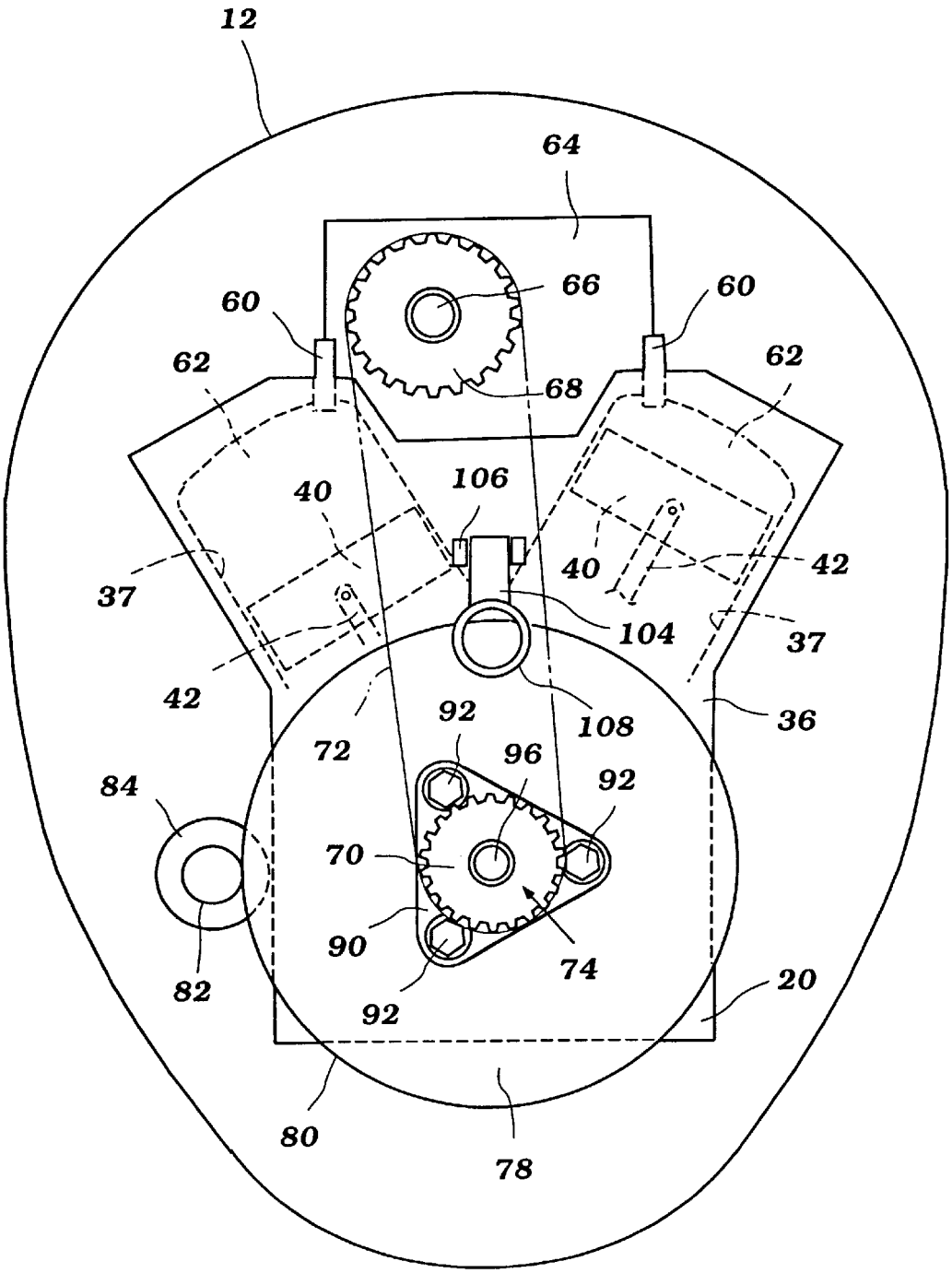
FIG. 2 is a top view of the outboard motor of FIG. 1 having certain internal components illustrated with hidden lines.

With continued reference to FIGS. 1 and 2, the illustrated engine 20 further comprises a flywheel magneto arrangement 76 that is mounted to an upper end of the illustrated crankshaft 38. The flywheel arrangement 76 generally comprises a flywheel 78 that is mounted to an upper end of the illustrated crankshaft 38 for rotation about the same axis in the illustrated embodiment. In the illustrated embodiment, the flywheel carries magnets and forms a rotor of a electrical generator. An armature (not shown) is joined to the engine and is attached proximate a bearing carrier of the crankshaft or other output shaft.

With continued reference to FIG. 2, the illustrated flywheel 78 also carries a geared outer periphery 80 that meshes with a geared surface 82 of a starter motor 84 to enable the starter motor 84 to provide an initial turning to the crankshaft 38 through the flywheel 78 in order to assist in starting the engine 20. It is anticipated that the present lifting arrangement may also find utility in engines having pull-start, other manual starting arrangements or other electric starting arrangements as well.

With reference now to FIGS. 1 and 2, a hanging arrangement for the engine 20 will be described in detail. As illustrated in FIG. 2, the engine comprises a sprocket support 90 that is attached to an upper surface of the flywheel 78 in the illustrated embodiment. The sprocket support 90 is preferably splined or keyed to the sprocket 70 of the drive unit 74 such that the sprocket support 90 and sprocket 70 turn together. It is envisioned, however, that the sprocket 70 may be capable of movement relative to the sprocket support 90 in some embodiments. For instance, the sprocket may be carried by a bearing or bushing such that the sprocket 70 may turn with a large degree of freedom relative to the sprocket support 90. Moreover, the sprocket may be directly attached to the flywheel in some embodiments without the use of a sprocket support 90.

Figure 3A:
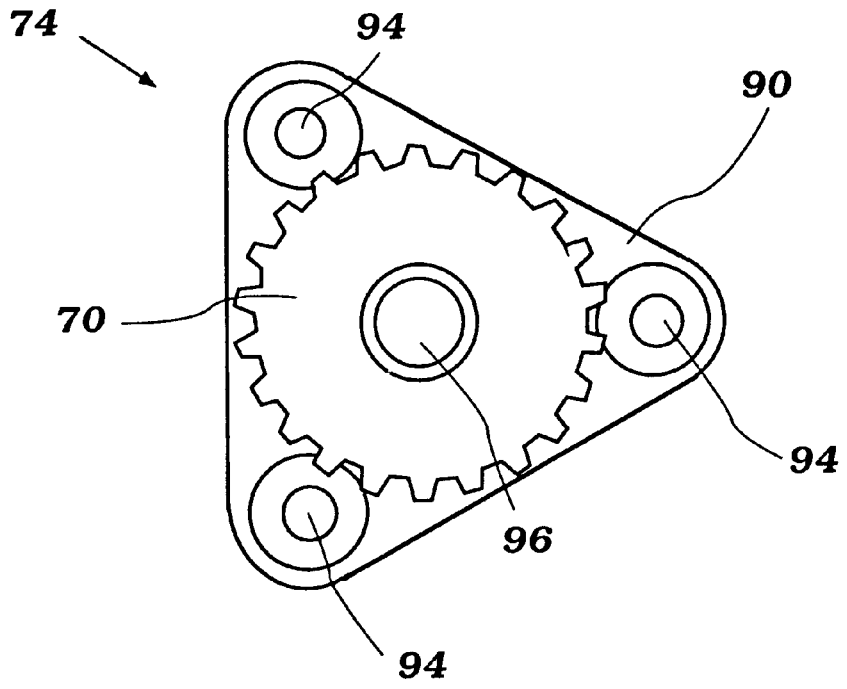
FIG. 3A is a top view of a high pressure fuel pump drive arrangement including a lifting lug support assembly.
Figure 3B:
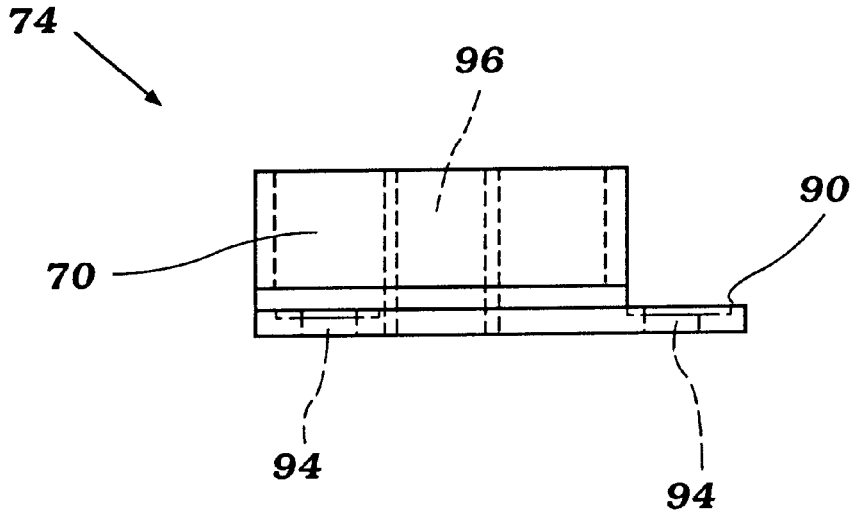
FIG. 3B is a side view of the arrangement of FIG. 3A.

With reference now to FIGS. 3A and 3B, the illustrated sprocket support 90 will be described in greater detail. As introduced above, the sprocket support 90 is desirabley affixed to the flywheel 78. In the illustrated embodiment, the sprocket support 90 is advantageously attached through the use of threaded fasteners 92. The use of the threaded fasteners enables ease of removal and replacement of the sprocket support during routine maintenance. Of course, the sprocket support may also be attached in other manners, such as, for example but without limitation, welding, clamping or the use of interlocking features.

The fasteners 92 of the illustrated embodiment extend through a plurality of apertures 94 in the stay 90. The apertures 94 are preferably slightly countersunk. The countersink may allow the fasteners 92 to protrude upwardly from the sprocket support 90 to lesser degree than using the fasteners 92 without the countersinks. In the embodiment of FIGS. 3A–3B, three apertures 94 are used. It is anticipated, however, that as few as one or more than two apertures may also serve to secure the sprocket support 90 to the upper surface of the flywheel 78. With reference to FIG. 4B, the support in the illustrated embodiment is preferably affixed directly to the flywheel; however, as will be described below, the support 90 may also be spaced apart from the flywheel or other engine surface in some embodiments.

In the illustrated embodiment, the support 90 is preferably triangular in shape having one aperture 94 positioned in each apex of the triangle. While it is not critical that the support 90 be triangular in configuration, it is desirable that the support have a generally symmetrical appearance. A symmetrical appearance may result in a more balanced rotation than otherwise possible. It is anticipated, however, that other shapes may be utilized. In such instances, it is desirable to locate an axis of rotation of the support to be aligned with the center of mass of the support unless an appropriately positioned counterbalance is utilized. Moreover, the off-center center of mass may be used to off-set other component motion if desired or advantageous.

The illustrated support 90 further comprises a centrally located threaded hole 96 into which a lifting lug, described in more detail below, may be inserted. The hole 96 may also extend through the sprocket 70 in embodiments in which the sprocket is directly mounted to the flywheel. Such an embodiment would eliminate the support and simplify the construction. The lifting lug, when coupled to the support 90, or sprocket, is used to raise and lower the engine 20 into and out of the outboard motor power head 12. Notably, the threaded hole 96 may also be located in other regions of the support 90 or sprocket 70; however, the central location of the illustrated support is presently preferred as it reduces bending forces created in the connection to the crankshaft of the illustrated embodiment.

Figure 4A:
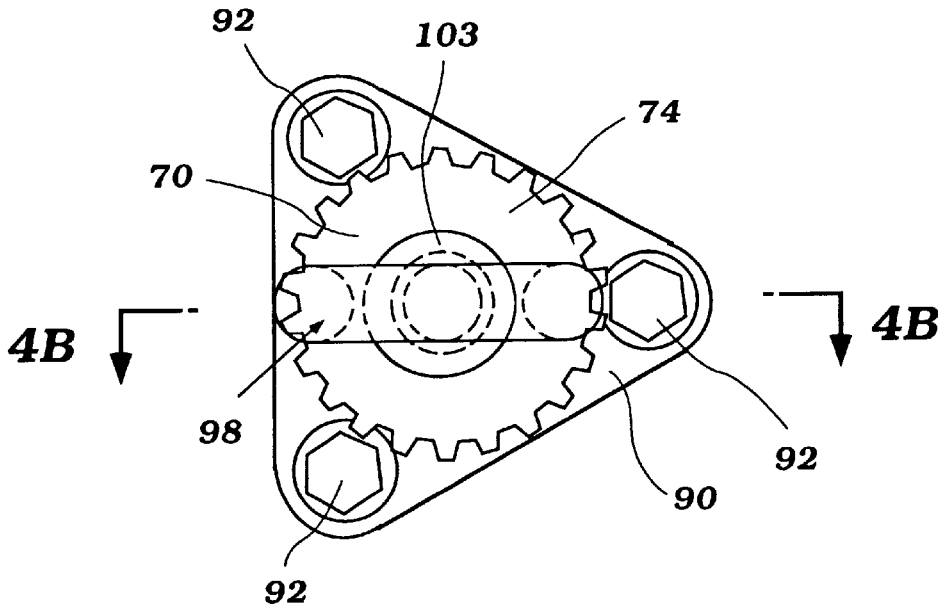
FIG. 4A is a top view of the embodiment of FIG. 3A with a removable lifting lug installed within the lifting lug support assembly.
Figure 4B:
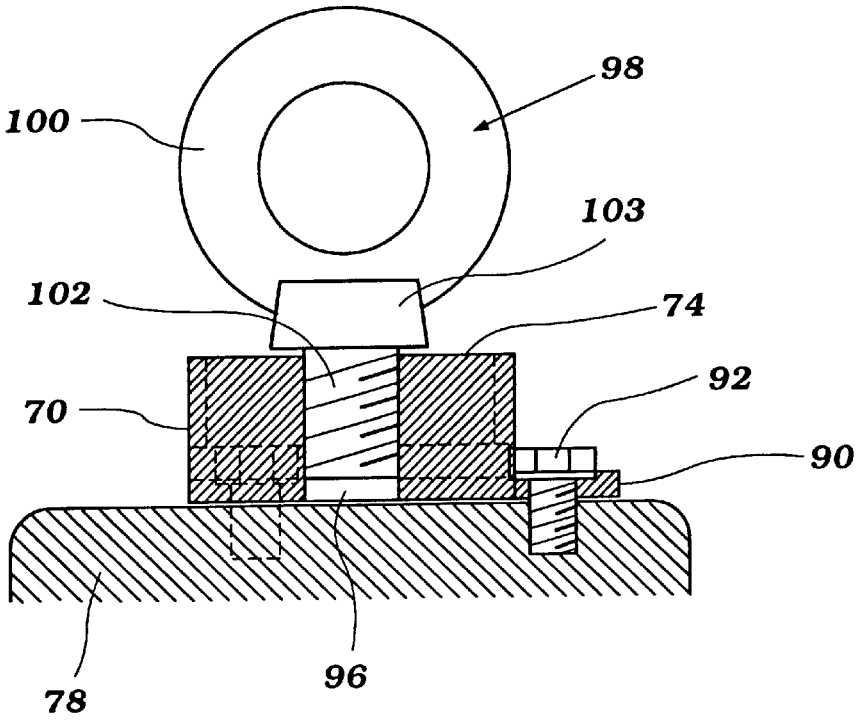
FIG. 4B is a side view in partial section taken along the line 4B—4B in FIG. 4A.

With reference now to FIG. 4A, a lifting lug 98 is illustrated in a presently preferred lifting arrangement. The lifting lug 98 is shown assembled to the flywheel 78 through the support 90. As discussed above, the lifting lug 98 may also be attached directly to the sprocket or pulley 70, the flywheel 78, or the crankshaft 36. With reference now to FIG. 4B, the lifting lug 98 generally comprises a grappling portion 100 and a support engaging portion 102. The lifting lug 98 may also be formed as an integral component of the support or other element that is removably attached to the engine. The grappling portion may comprise a hook, a threaded eyebolt, a T-bar, or any other suitable member featuring a graspable component such that a chain, a rope or the like may be fastened to the engine through grappling portion 100. In a presently preferred structure, the grappling portion 100 is an eyebolt. The support engaging portion 102 may assume any of number of suitable configurations. In some embodiments, the support engaging portion may feature multiple threads. In other embodiments, a quick-release arrangement may be employed such that the support engaging portion may be engaged and disengaged with less than a full revolution. In one presently preferred embodiment, the support engaging portion features a single standard thread that begins at one end of the support engaging portion 102 and terminates proximate an enlarged portion 103 that forms a stop.

With reference now to FIGS. 5A–6B, another lift assembly will be described in detail. As shown in FIGS. 1 and 2, a pivotable lifting lug 104 is preferably nestled within a valley defined between the banks of cylinders. Positioning the lifting lug 104 in the valley takes advantage of space not utilized by engine accessories or peripheral components. Further, as illustrated in FIG. 2, the positioning allows the lifting lug 104 to lie within the loop of the drive belt 72 of the drive unit 74. Such positioning again takes advantage of dead space within the engine profile.

Figures 5A, 5B:
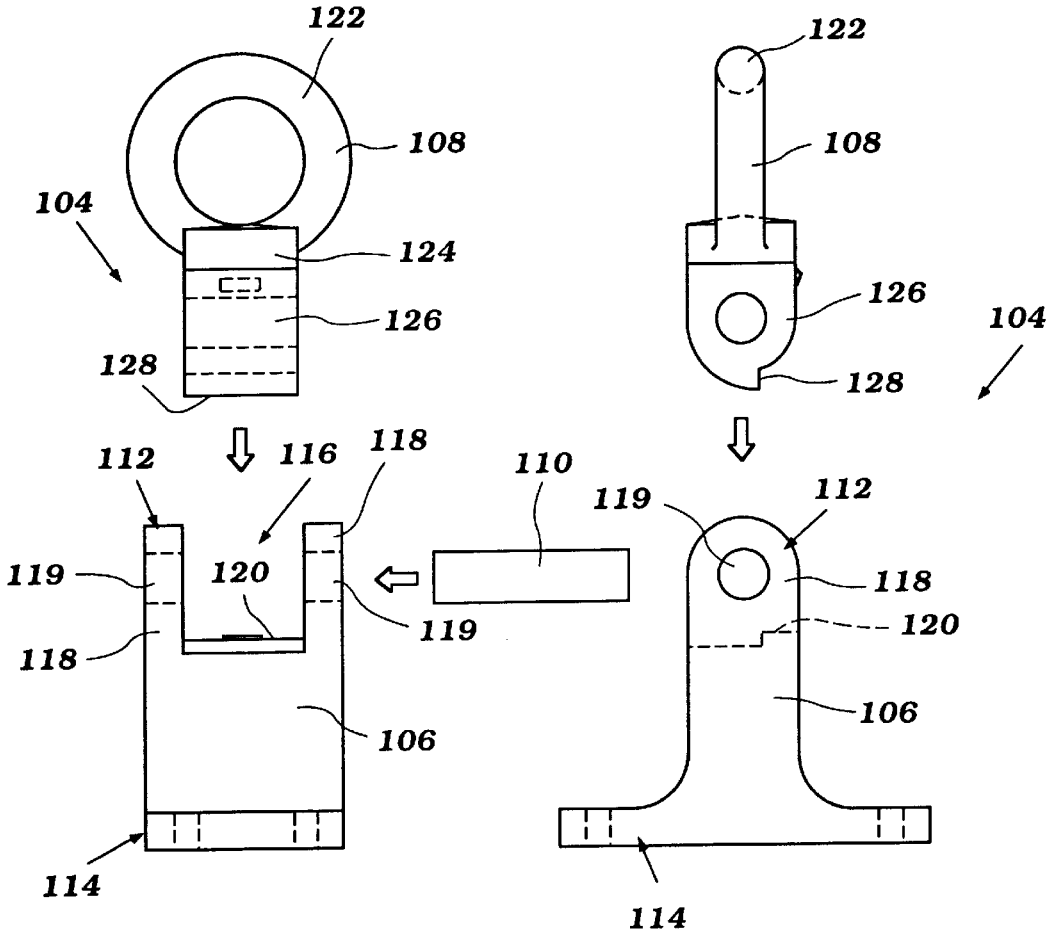
FIG. 5A is an exploded side view of a secondary pivoting lifting lug having features, aspects and advantages in accordance with the present invention.
FIG. 5B is a side view of the pivoting lifting lug of FIG. 5A.

With reference to FIGS. 5A and 5B, the pivotable lifting lug 104 generally comprises a pedestal portion 106 and a grappling portion 108. The grappling portion 108 is desirably pivotably attached to the pedestal portion 106 with a pin 110 in the illustrated embodiment. Accordingly, the illustrated grappling portion 108 may be pivoted into an upright position for use and pivoted downward into a stowed position when not in use.

The illustrated pedestal portion, as depicted in FIGS. 5A and 5B, generally comprises a supporting yoke 112 at one end and a foundational mounting boss 114 at the other. The supporting yoke 112 generally comprises a u-shaped channel 116 defined between two legs 118. A pair of generally aligned apertures 119 extend through the legs 118 such that one aperture 119 extends through each leg 118. The apertures 119 are preferably sized and configured to receive the pin 110. The pin may be force fit, may be a threaded member held in position with a nut, may be a grooved pin, may be a roll pin, may be a spiral pin, may be a cotter pin, may be a rivet or may be any other mechanical element, for example, capable of securing the grappling portion 108 to the pedestal portion 106 such that one may rotate relative to the other. The apertures 119 may or may not extend all the way through the legs 118. The presently preferred embodiment, however, features two holes that extend through the legs such that the supporting yoke may be easily and inexpensively manufactured.

Moreover, a stepped ledge 120 is positioned within the channel 116. In the illustrated embodiment, the ledge 120 extends between both legs 118. It is anticipated, however, that the ledge may extend only partially between the legs 118 or that the ledge may be constituted of several portions, such as, for example but without limitation, a series of serrated teeth. The ledge 120, as will be described below, advantageously limits the travel of the upper grappling portion 108 as it pivots within the channel 116.

The mounting boss portion 114 of the pedestal 106 is the location at which the illustrated pivotable lifting lug 104 is attached to the engine 20. The illustrated mounting boss portion 114 is configured as a t-shape; however, many other configuration are also possible and may be readily interchanged to securely mount the lifting lug 104 to the engine 20. Moreover, apertures are formed within each of the bars of the T-configuration through which threaded fasteners extend when connecting the lifting lug 104 to the engine or any other suitable mounting surface.

With continued reference to FIGS. 5A and 5B, the illustrated grappling portion 108 is pivotably connected to the pedestal portion 106. The grappling portion, as in the lifting lug of FIG. 3A–3B, may assume any of a number of shapes and configurations. The illustrated grappling portion 108 comprises a ring 122 and a body 124. The ring 122 and the body 124 are preferably welded together to form a contiguous member; however, the two portions may also be formed as a unitary body using any suitable method, such as forging.

The illustrated body 124 has a through hole 126, for accommodating the pin 110, and a stopper edge 128. The through hole 126 should be sized to allow relative movement between the pin 110 and the body 124. In configurations in which the pin 110 does not rotate relative to the body 124, the pin 110 should rotate relative to the yoke 112. Of course, the pin 110 and apertures 119 could be replaced by a shaft extending from either end of the grappling portion to be secured within the pedestal portion in any suitable manner. In such instances, the shaft may be integrally formed with the grappling portion 108 and the pedestal portion 106 may contain slots or apertures to allow the shaft to be inserted and secured held by the pedestal portion 106.

The stopper edge 126, similar to the ledge 120, may extend the entire width of the body 124. The edge 126 may also have may other configuration, such as those described above in reference to the ledge 120. Generally, the edge 126 contacts the ledge 120 and limits the rotation of the grappling portion 108 within the yoke 112 of the pedestal portion 106. This allows the pivotable lifting lug to be raised for use without excessive pivoting of the two portions while being used. The edge 126 and ledge 120 should be sized and configured to have adequate strength and contact surface area to resist undesired motion when in contact and to avoid undesired deformation while being used. Such sizing and configuring may vary from application to application.

Figure 6A:
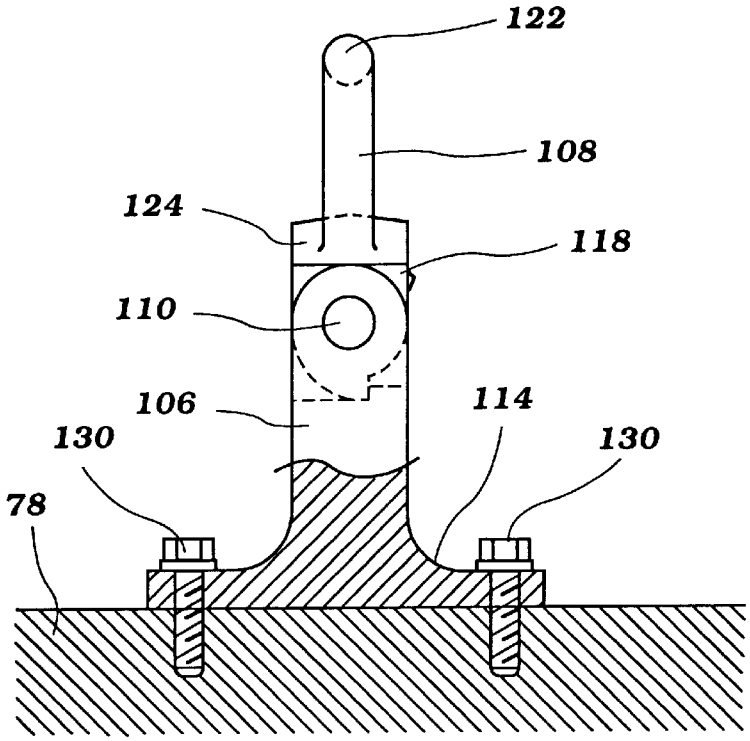
FIG. 6A is a partially sectioned side view of the pivoting lifting lug shown in FIG. 5A assembled and affixed to an engine block.
Figure 6B:
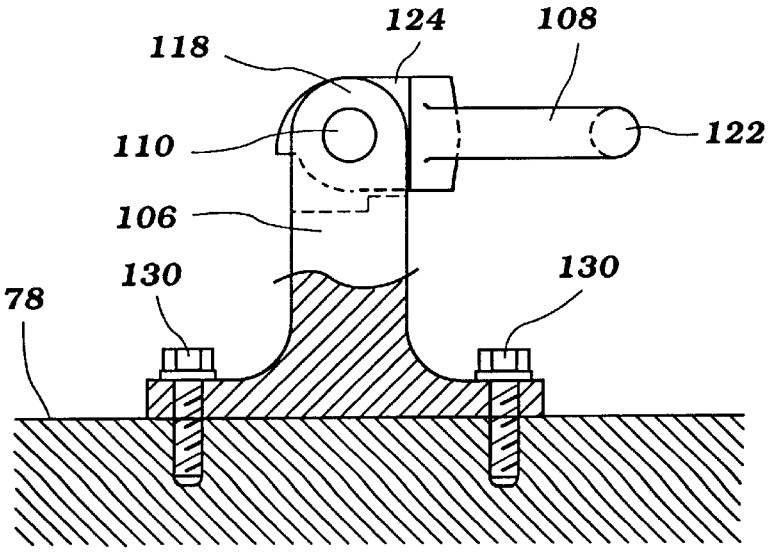
FIG. 6B is a partially sectioned side view of the pivoting lifting lug shown in FIG. 5A in a stowed configuration.

With reference now to FIGS. 6A and 6B, the pivotable lifting lug of FIGS. 5A and 5B is illustrated as attached to an upper surface of a flywheel magneto therein. As described above, a set of threaded fasteners 130 are used to attach the pedestal portion 106 of the lifting lug to the flywheel 78. Of course, the threaded fasteners may be of any suitable type, including but not limited to, bolts, threaded rods and threaded studs welded to the flywheel. FIGS. 6A and 6B also illustrate a desired range of motion for the illustrated embodiment. In one embodiment, the range of motion is approximately 90 degrees. In another embodiment, the range of motion is between approximately 70 degrees and 115 degrees. As illustrated, the range of motion may be limited by the sizing of the body 124 and the yoke 112 as well as the sizing and configuration of the edge 128 and ledge 120.

With reference to FIG. 1, the pivotable lifting lug is positioned in a valley defined between the two banks of cylinders. It should be appreciated that any number of positions are position. The illustrated positioning advantageously reduces the likelihood of inadvertent contact of lifting apparatus with components of the engine. Moreover, it is desired that the positioning results in a fairly balanced engine when suspended by the lifting apparatus. Accordingly, in some embodiments, the lifting lug is positioned proximate a axis that extends in a generally vertical direction through approximately a center of mass of the assembled engine. In other embodiments, the lifting lug is positioned along a plane that extends approximately through the center of mass. In one presently preferred embodiment, the lifting lug is positioned along a longitudinally extending generally vertical plane that extends through approximately the center of mass.

Figure 7A:
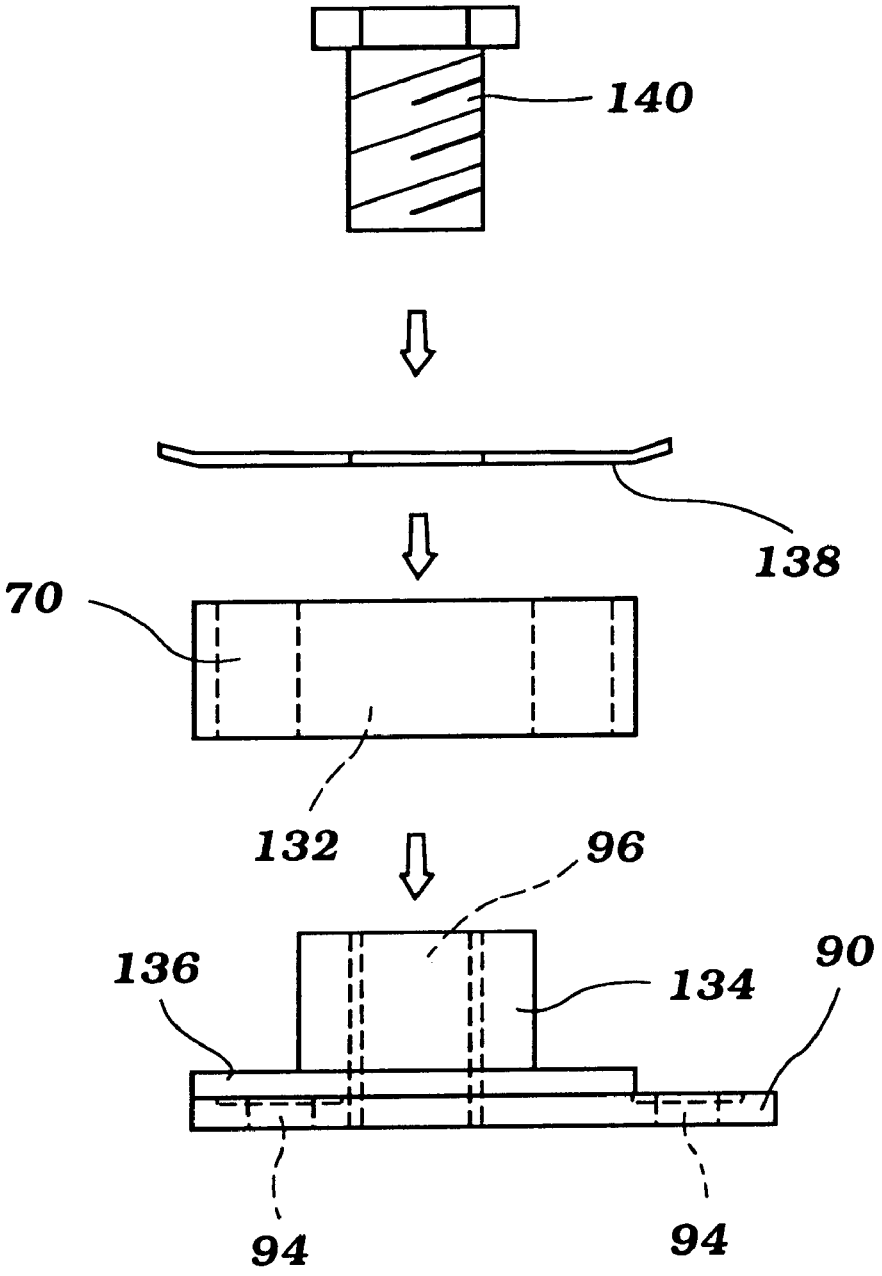
FIG. 7A is an exploded side view of another lifting lug support assembly illustrated with a removable lifting lug removed from the assembly.
Figure 7B:
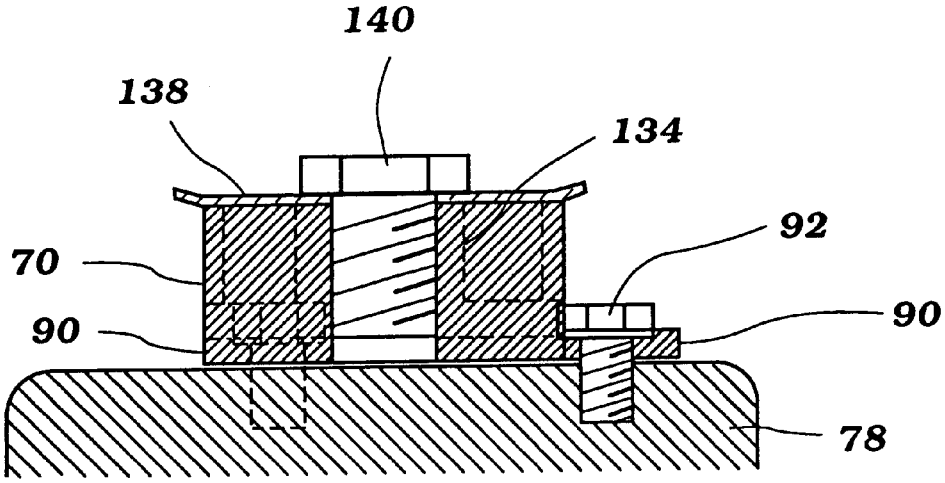
FIG. 7B is a partially sectioned side view of the arrangement of FIG. 7A.
Figure 7C:
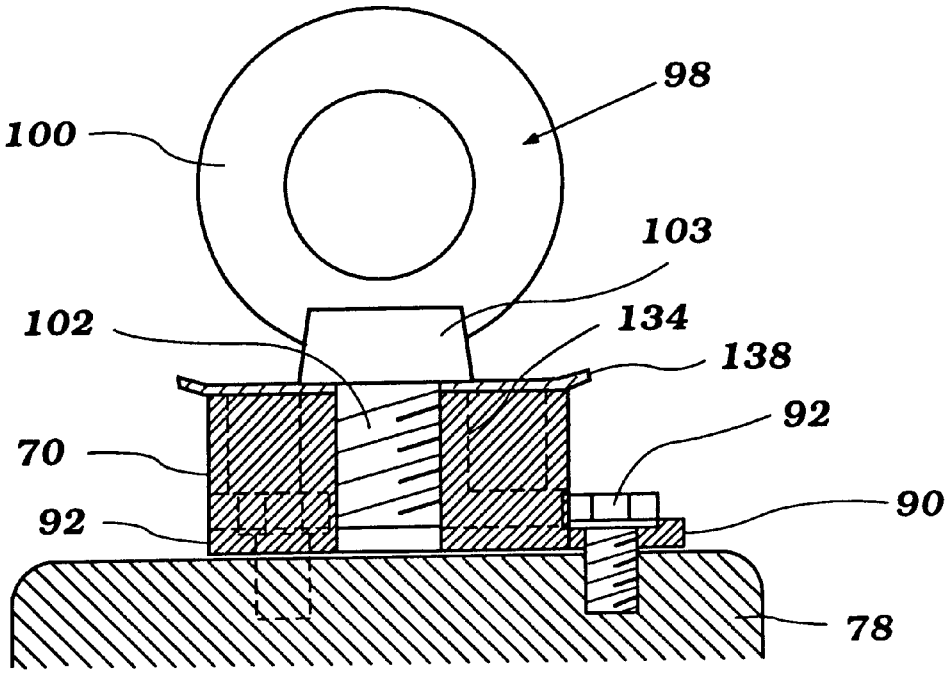
FIG. 7C is a partially sectioned side view of the lifting lug support assembly of FIG. 7A with a removable lifting lug installed in the lifting lug support assembly of FIG. 7A.

With reference now to FIGS. 7A–7C, another lift arrangement is illustrated therein. Because many of the elements are similar to the above described embodiments, the description above should be considered to apply to the embodiments disclosed in FIGS. 7A–8F unless otherwise indicated. Moreover, like reference numerals will refer to like elements in each embodiment. As illustrated in FIG. 7A, the sprocket 70 contains a through hole 132 that is sized and configured to be positioned over a seat 134 of the sprocket support 90. The seat 134 in the illustrated embodiment is sized such that the sprocket 70 may rotate relative to the seat 134 and the support 90; however, it is anticipated that the seat 134 and the sprocket 70 may sized and/or configured (press fit, keyed, splined, or otherwise coupled) such that the two rotate together as a unit. In the illustrated embodiment, a lubricous surface 136 may be positioned to encourage movement of the sprocket 70 relative to the support 90 by reducing surface friction between the two components. For instance, but without limitation, the surface may be coated or formed of brass.

With continued reference to FIG. 7A, the sprocket 70 is secured on the seat 134 with the use of a locking plate 138. The locking plate 138 may be a simple pan washer or may be any other shape or configuration which helps to secure the sprocket from working off of the seat 134. In the illustrated embodiment, a ring plate 138 having an upturned periphery is secured to the seat 134 over the sprocket 70 with a fastener 140 that threads into the threaded aperture 96 of the support 90. The support may also have a threaded portion such that a nut holds the plate 138 in position. Moreover, any other suitable fastening method may be used to limit the axial travel of the sprocket 70 relative to the seat 134.

With reference now to FIGS. 7B and 7C, the lift arrangement of FIG. 7A is illustrated with assembled to the upper surface of the flywheel 78 in FIG. 7B and with a removable lifting lug in FIG. 7C. As each of the features has been described above in detail, further description of the illustrated embodiment is deemed unnecessary.

Figure 8A:
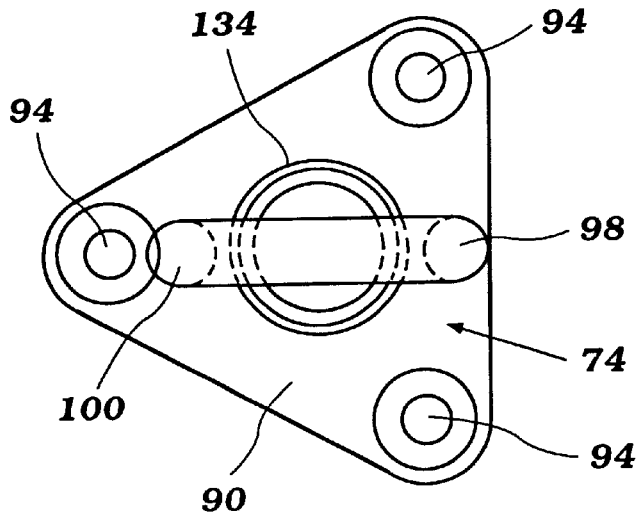
FIG. 8A is a top view of another removable lifting lug installed within a lifting lug support assembly.
Figure 8B:
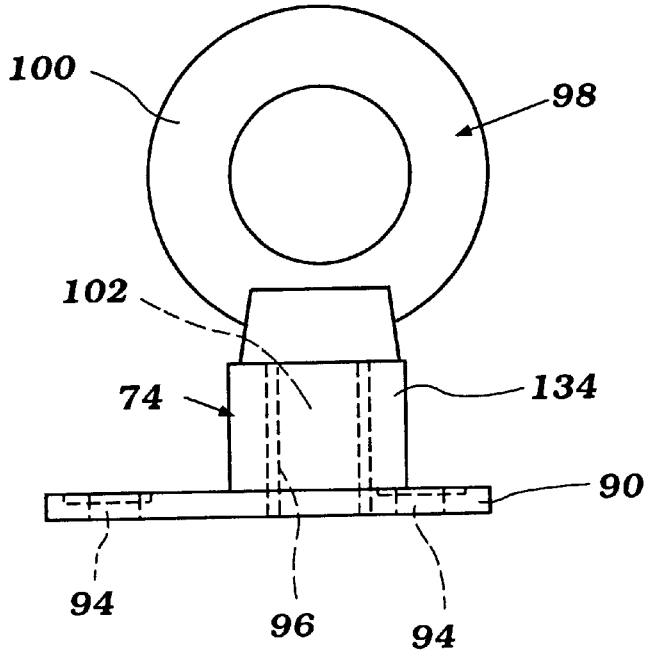
FIG. 8B is a side view of the removable lifting lug and lifting lug support assembly shown in FIG. 8A.

With reference now to FIG. 8A through 8F, more lift arrangements are illustrated therein. The arrangement of FIGS. 8A and 8B is very similar to that of FIG. 7A through 7C, with the exception that no sprocket is positioned on the seat 134. In fact, two mounting assemblies of the arrangement of FIGS. 8A and 8B are illustrated in FIGS. 8C and 8D and FIGS. 8E and 8F respectively.

Figure 8C:
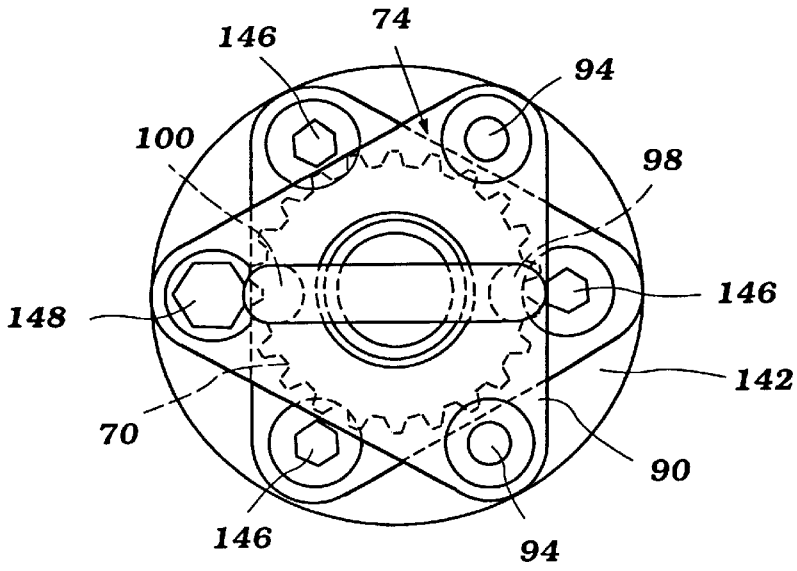
FIG. 8C is a top view of a high pressure fuel pump drive arrangement including a lifting lug support assembly similar to that illustrated in FIG. 8A.
Figure 8D:
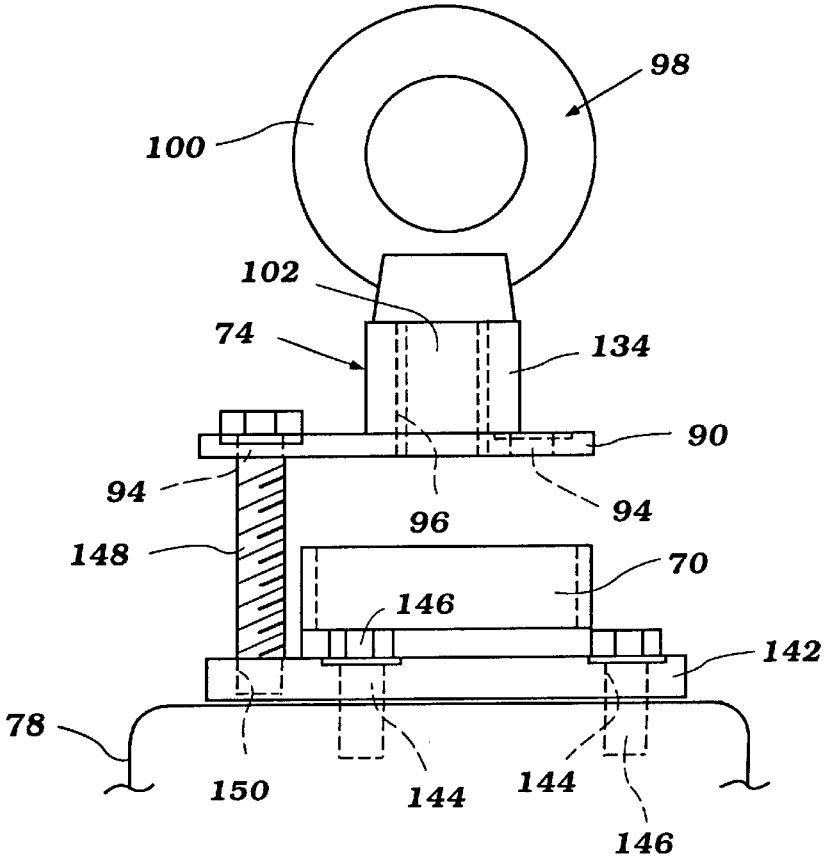
FIG. 8D is a side view of the arrangement of FIG. 8C.
Figure 8E:
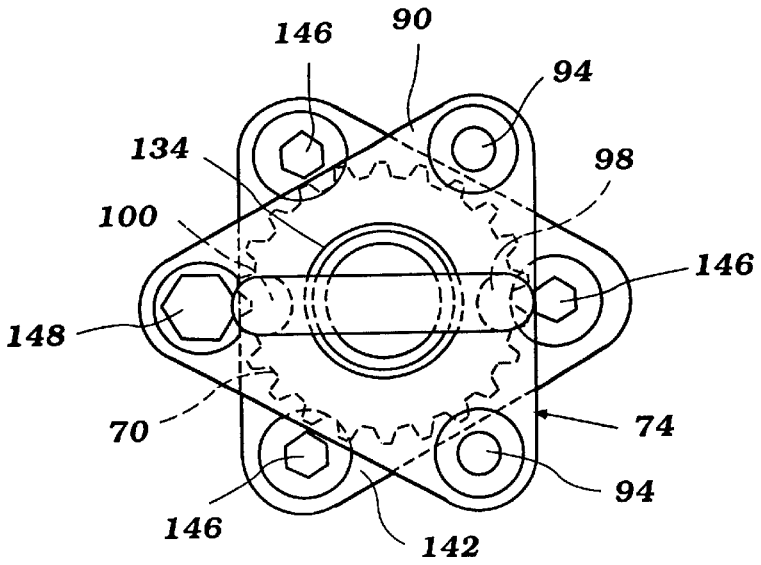
FIG. 8E is a top view of yet another removable lifting lug installed within a lifting lug support assembly similar to that illustrated in FIG. 8A; and, FIG. 8F is a side view of the removable lifting lug and lifting lug support assembly shown in FIG. 8E.
Figure 8F:
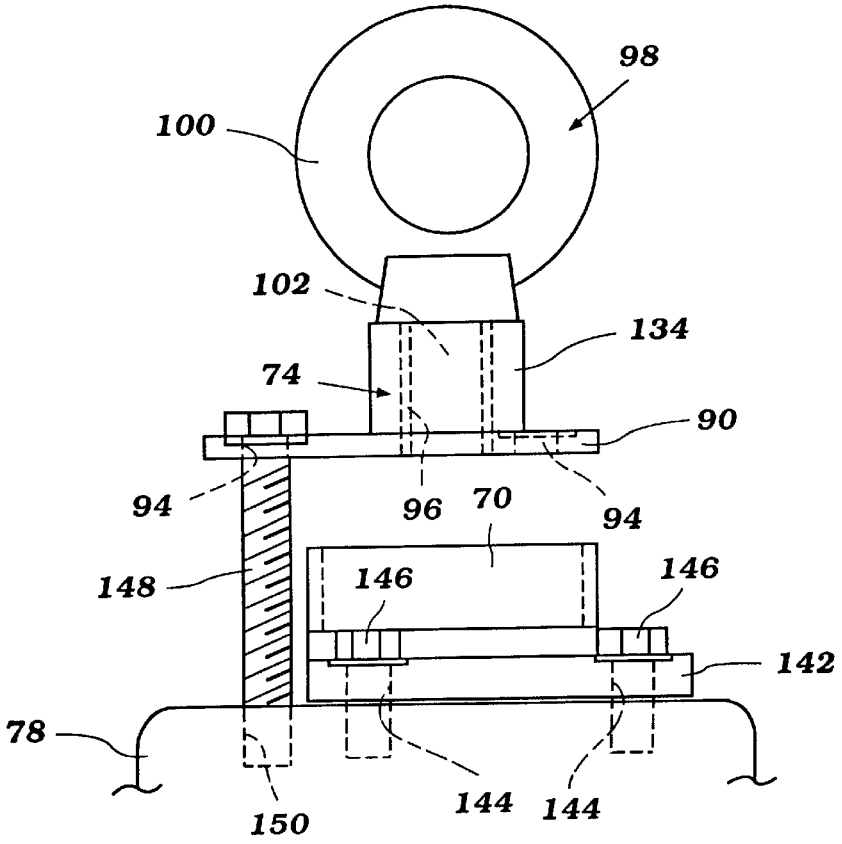

With reference to FIGS. 8C and 8D, the support of FIGS. 8A and 8B is shown attached to a sprocket carrier 142. In the illustrated embodiment, the sprocket carrier is configured with apertures 144 through which threaded fasteners 146 extend. Such an embodiment does not compromise the sprocket 70 or other components through positioning a hole in the component. The threaded fasteners 146 affix the sprocket carrier to the flywheel 78 in the illustrated embodiment. Of course, other mounting methods, such as those discussed above in relation to the sprocket support 90, may also be used. Further, the sprocket support 90 is preferably spaced from and suspended above at least a portion of the sprocket carrier 142 through the use of an additional threaded fastener 148. According to the illustrated assembly, the fastener 148 may extend through any of the apertures 94. Preferably the aperture is threaded such that the position of the support 90 may be fixed along the fastener 148. It is anticipated that a nut may hold the support 90 in a desired position along the fastener in some embodiments. Moreover, other suitable spacing techniques may also be used. While the fastener 148 extends into a hole in the carrier 142 in the illustrated arrangement, the fastener may also extend into a surface of the engine or the flywheel in other arrangements. Such an embodiment is illustrated in FIGS. 8E and 8F. Moreover, the support may be removed or, in one embodiment, the lifting lug may be removed without removing the support if no lifting lug is needed (i.e., during standard operating conditions).

It is to be understood that the present lifting arrangement may use one or more lifting lug, either pivotable or otherwise. Moreover, the lifting lugs may be permanently attached to the engine or a peripheral component or may be removably attached to the same. The lifting lugs may be directly attached to a sprocket carrier or may be positioned elsewhere on the engine or the peripheral components. Although the present invention has been described in terms of certain embodiments and arrangments, other embodiments and arrangements apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow.

What is claimed is:

1. An engine for an outboard motor, the engine comprising a generally vertically oriented crankshaft, a flywheel connected to the crankshaft, a peripheral component attached to a portion of the engine, a driven sprocket connected to the peripheral component and arranged to power the peripheral component, a drive sprocket attached to the flywheel, a flexible drive loop extending between and rotatably coupling the drive sprocket to the driven sprocket, a lifting lug is removably connected one of the flywheel or the drive sprocket.

2. The engine of claim 1, wherein a sprocket support attaches the drive sprocket to the flywheel.

3. The engine of claim 1, wherein the lifting lug is connected solely to the drive sprocket though at least one intermediate member.

4. The engine of claim 3, wherein the intermediate member is a sprocket carrier.

5. The engine of claim 1, wherein the lifting lug is directly connected solely to the drive sprocket.

6. The engine of claim 2, wherein the sprocket support is spaced from the flywheel through an intermediate member.

7. An engine for an outboard motor, the engine comprising a crankshaft, a flywheel attached to the crankshaft, a peripheral component attached to a portion of the engine, a driven sprocket connected to the peripheral component and arranged to power the peripheral component, a drive sprocket attached to the flywheel, a flexible drive member coupling the drive sprocket to the driven sprocket, and a lifting lug positioned between the drive sprocket and the driven sprocket.

8. The engine of claim 7, wherein the lifting lug has a grappling portion that is pivotably attached to a mounting portion, the grappling portion being pivotable between a useable position and a stowed position.

9. The engine of claim 8, wherein the lifting lug is capable of pivoting through a complete range of motion of approximately 90 degrees.

10. The engine of claim 8, wherein the grappling portion extends up above an upper surface of the engine when positioned in the useable position and folds into a stowed position such that the grappling portion overlaps a portion of the flywheel.

11. An outboard motor comprising a power head, an engine compartment defined within the powerhead, an engine mounted within the engine compartment, the engine comprising a crankshaft, a crankcase encasing the crankshaft, a flywheel attached to the crankshaft, the crankcase attached to a cylinder block, a pair of cylinder banks positioned within the cylinder block, a removable lifting lug and a pivotable lifting lug, one of the removable lifting lug and the pivotable lifting lug positioned generally above the crankshaft, the other of the removable lifting lug and the pivotable lifting lug positioned generally rearward of the crankshaft.

12. The outboard motor of claim 11, wherein the rearmost of the lifting lugs is positioned generally between the two banks of cylinders.

13. The outboard motor of claim 12 further comprising a generally vertical plane extending through the removable lifting lug and the pivotable lifting lug, the vertical plane also extending through a position proximate a center of mass of the assembled engine.

14. The outboard motor of claim 12, wherein the removable lifting lug is connected to the flywheel.

15. The outboard motor of claim 14 further comprising a pulley affixed to the flywheel, wherein the removable lifting lug is connected to the flywheel through the pulley.

16. The outboard motor of claim 15 further comprising a pulley support, wherein the pulley is attached to the crankshaft through at least one of the pulley support and the flywheel.

17. The outboard motor of claim 16, wherein the pulley is configured to rotate relative to the pulley support.

* * * * *